United States Patent [19]

Trenam

[11] 3,938,151

[45] Feb. 10, 1976

[54] PASSIVE RADAR DECOY HAVING A LARGE CROSS SECTION

[75] Inventor: Richard S. Trenam, Adelaide, Australia

[73] Assignee: The United States of America as represented by the Secretary of the Navy, Washington, D.C.

[22] Filed: Aug. 14, 1970

[21] Appl. No.: 70,612

[52] U.S. Cl. ..... 343/18 B; 343/795
[51] Int. Cl.[2] ..... H01Q 15/00
[58] Field of Search ..... 343/18 B, 795

[56] References Cited

UNITED STATES PATENTS

| | | | |
|---|---|---|---|
| 3,789,404 | 1/1974 | Munk | 343/18 B |
| 3,860,927 | 1/1975 | Ota et al. | 343/18 B |

*Primary Examiner*—T. H. Tubbesing
*Attorney, Agent, or Firm*—R. S. Sciascia; G. J. Rubens; H. Fende

[57] ABSTRACT

A passive EW radar decoy capable of simulating relatively large targets such as naval ships. The decoy comprises a cylindrical, dimensionally stable plastic balloon having uniformly distributed on the surface thereof a Van Atta array of printed circuit radiators. The radiators in the array are disposed in a selectively predetermined geometric configuration such that incident energy from a remote source is reradiated by the array in the direction of the remote source. The decoy comprises a low-cost, light-weight, relatively simple structure that can be easily stored and rapidly deployed and released.

4 Claims, 4 Drawing Figures

INVENTOR.
RICHARD S. TRENAM
BY
George F. Rubens
ATTORNEYS

INVENTOR.
RICHARD S. TRENAM

BY

George J. Rubens
ATTORNEYS

PASSIVE RADAR DECOY HAVING A LARGE CROSS SECTION

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

Existing radar decoys capable of providing relatively large echoing areas to thereby simultate large targets such as ships generally comprise corner reflector structures or chaff techniques. Both of these decoys are characterized by certain disadvantages which limit their usefulness. For example, to provide an echoing area in the order of $10^4$ square meters at X-band, a corner reflector structure must have edges approximately 1.5 meters long, angular tolerances of approximately $\pm$ ½°, and surface flatness tolerances of approximately $\pm$ ½ centimeters. Obviously such a decoy that simulates a large ship, such as a destroyer, cannot be easily manufactured in a low-cost manner to provide a lightweight structure that can be easily stored, transported, and rapidly deployed. A large target can be simulated by means of a chaff cloud of suitable dimensions that is deployed from chaff rockets, shells, or helicopters. A chaff cloud deployed in such a manner however requires an appreciable time to bloom or to spread to a useful size that provides the desired echo. The weight of chaff rockets and shells is appreciable, and furthermore helicopter deployment of chaff is time consuming because the helicopter must be allowed time to reach a suitable position for chaff release. An ideal large echo-area decoy should be capable of being very rapidly deployed because of the speed with which attacks often develop and should be a low-cost and lightweight structure so that a ship can carry many decoys and thus release a decoy whenever there is a suspicion of an impending attack.

SUMMARY OF THE INVENTION

A passive radar decoy having a high cross-section and comprising a Van Atta array of printed circuit radiators uniformly distributed on the surface of a cylindrical plastic balloon is disclosed. Pairs of radiators in the array are coupled by means of equal-length transmission lines. The array of coupled radiators is arranged in a selectively predetermined geometrical configuration such that incident radiation upon the array from a remote source is reradiated in the direction of the source. The radiators can comprise printed circuit dipoles printed on a cylindrical surface of plastic film having plastic and surfaces to thereby provide a completely enclosed volume that can be filled with gas to provide large echoing areas similar to large ships.

STATEMENT OF THE OBJECTS OF THE INVENTION

It is the primary object of the present invention to provide a passive, low-cost radar decoy that can produce target echoing areas similar to those of large naval ships.

It is another object of the present invention to provide a large echoing area radar decoy that can be easily stored and transported and rapidly deployed.

Other objects, advantages and novel features of the invention will become apparent from the following detailed description of the invention when considered in conjunction with the accompanying drawings wherein:

DESCRIPTION OF THE PREFERRED EMBODIMENT

The invention disclosed herein comprises a passive radar decoy that can provide an echoing area similar to that of large targets such as naval ships. Such a large area decoy can be utilized effectively to confuse or distract enemy attackers and to defend naval ships or other targets against radar directed missile attacks.

The novel radar decoy disclosed herein comprises a Van Atta array of printed circuit dipole antennas uniformly distributed on the surface of a cylindrical, plastic balloon. Each dipole in the array is coupled by a transmission line to a second dipole. All the transmission lines are of equal length. The array of coupled dipoles is formed into a selectively predetermined geometrical configuration such that when radiation is incident upon the array from a remote source the array absorbs the incident energy and reradiates it in the direction of the source.

Figure 1:
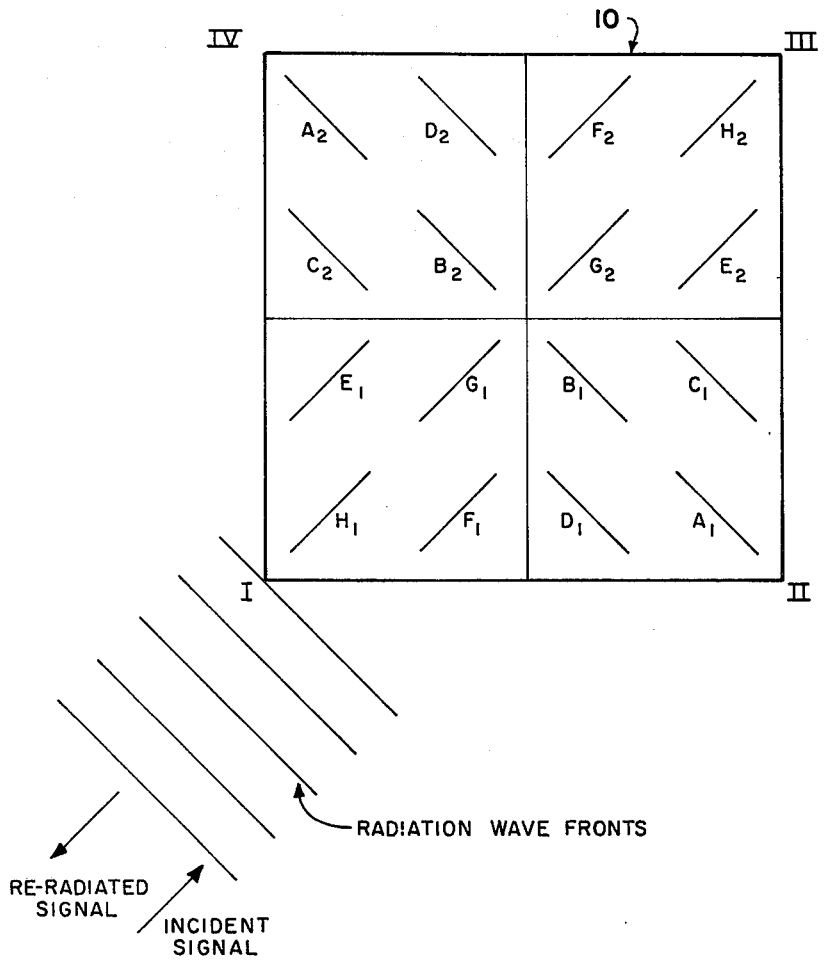
FIG. 1 is a simplified schematic diagram of a linear dipole array configuration that reradiates incident radiation in the direction of the radiation source.

FIG. 1 illustrates a flat plane 10 having four quadrants, I, II, III, and IV, being illuminated by a plane wave of incident RF radiation. The plane is shown having disposed and printed on the surface thereof an array of printed circuit dipoles that are connected in pairs by transmission lines of equal length (not shown). Two dipoles of each pair are placed with mirror symmetry about the center of the flat plane; for example, the dipole $A_1$ is connected to the dipole $A_2$, and the dipole $B_1$ is connected to the dipole $B_2$.

In FIG. 1 the incident radiation first reaches the dipole $H_1$ which absorbs a portion of the radiation. The absorbed energy is radiated from dipole $H_2$ in the third quadrant. Thus it can be seen that as the plane wave advances it reaches in sequence the geometrically disposed dipoles $E_1$, $F_1$, $G_1$, $C_2$, $B_2$, $D_2$, etc., and that the corresponding dipoles begin to radiate the absorbed energy in the same sequence. Furthermore, due to the symmetrical disposition of the dipole pairs, the reradiation from the dipole pairs combines to form a plane wave front travelling in the direction of the radiation source that produced the incident radiation.

If the dipole pairs are disposed in a Van Atta array about the circumference of a circular surface, the required symmetry would be for each connected pair of dipoles to be at opposite ends of a diameter of the circular area.

Figure 2:
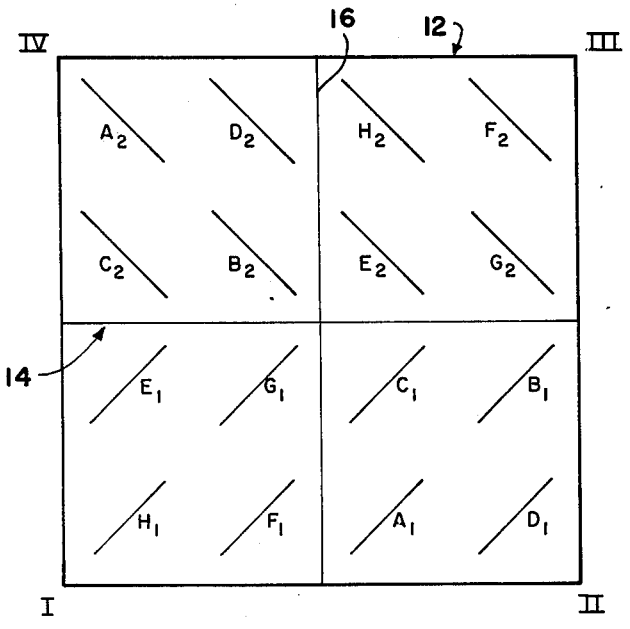
FIG. 2 is a simplified schematic diagram of a cylindrical dipole array configuration that reradiates incident energy in the direction of the radiation source.

If the dipoles are disposed on a cylindrical surface the required symmetry would be for each pair of dipoles to be on opposite ends of the diameter of a circular cross section of the cylinder and also to have mirror symmetry with respect to each other about the equatorial plane of the cylinder. This symmetry is illustrated in FIG. 2 wherein a cylinder 12 (having an equatorial plane 14) is shown as a flat surface. The flat surface can be formed into a cylinder by joining corner I to corner II and by joining corner III to corner IV to thus provide a cylindrical dipole array that can function to reradiate incident energy in the direction of the source. The geometrical configuration described can produce a reflection performance that will be equally effective over 360° azimuth if the axis of the cylindrical surface is maintained substantially vertical.

Obviously incident radiation must pass through the walls of the cylinder as it is coupled from one dipole to the corresponding dipole in the array. This passage of the radiation through the cylinder walls can be achieved with minimal losses or reflection by aligning the dipoles at 45° with respect to the vertical axis 16 of the cylinder.

Figure 3:
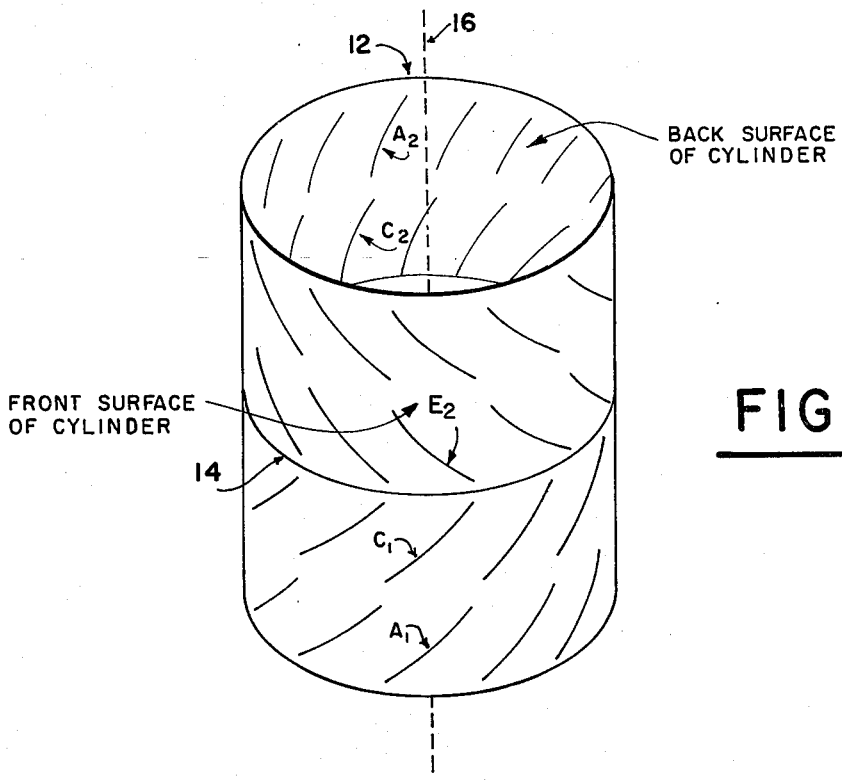
FIG. 3 is an isometric view of a high cross-section radar decoy balloon embodying the present inventive concept.

If the flat surface of FIG. 2 is joined as previously described to form a cylinder as shown in FIG. 3, it can be seen that the dipoles on one side of the equatorial plane 14 of the cylinder are oriented at right angles to the dipoles on the opposite side of the equatorial plane of the cylinder. For example, dipole $C_1$ is at right angles to dipole $E_2$ of FIG. 3. The dipoles $A_1$ and $C_1$, however, appear parallel to the dipoles $A_2$ and $C_2$ as these two dipoles are viewed from the back surface of the cylinder of FIG. 3. Thus the dipoles on one side of the cylindrical surface do not interfere with the radiation from the rear dipoles because the dipoles in each pair have orthogonal polarizations with respect to each other.

The orthogonal polarization of the dipole pairs in the array also functions to produce a reradiated signal having the same polarization as the incident signals received by the dipole $A_1$ are coupled to the dipole $A_2$ which reradiates the signals with substantially the same direction of polarization as the incident radiation signals.

If an incident radiation signal is linearly polarized substantially parallel to the dipole pair $A_1$ and $A_2$, the signal will be absorbed on the lower half of the front surface of the cylinder but will not interact with the upper half of the front surface of the cylinder. As the signal progresses through the cylinder it will be absorbed by the upper half of the rear surface of the cylinder.

Thus the signal will interact over the entire physical cross-section of the cylinder despite the fact that fifty-percent of the dipoles are cross-polarized and do not interact with the signal at all. Similar considerations can be applied to show that the cylinder will absorb energy over its whole physical cross-section for an incident signal having any direction of polarization.

Figure 4:
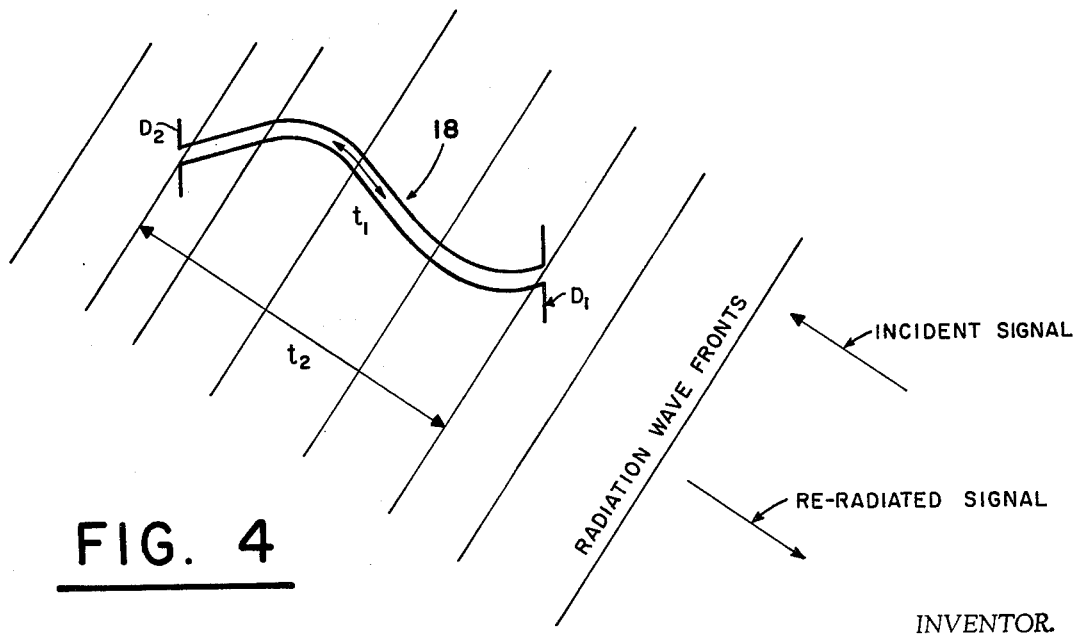
FIG. 4 is a simplified illustration of an incident signal being absorbed and reradiated by a dipole pair.

In the preceeding discussion an incident signal has been absorbed and reradiated in two portions. However, if all the transmission lines are the same length, it can readily be shown that the two reradiated signal portions combine coherently as if the reflection occurred at one surface. FIG. 4 illustrates this concept.

In FIG. 4, a first dipole $D_1$ is shown connected to a second dipole $D_2$ by a transmission line 18. If zero time is defined as the time at which the incident signal reaches the front dipole $D_1$, then power absorbed by the dipole $D_1$ is reradiated from the back dipole $D_2$ at a time $t = t_1$.

The reradiated power reaches the wavefront position at the dipole $D_1$ at a time $t = t_1 + t_2$ where $t_2$ is the time required for the incident signal to reach the dipole $D_2$. The power absorbed by dipole $D_2$ is reradiated from dipole $D_1$ at a time $t = t_1 + t_2$. Hence both reradiated signals require a time $t = t_1 + t_2$ to progress from the wave front position at dipole $D_1$ to the same position on their return path. Since the two signals were initially coherent, they will be coherently reradiated.

The radar decoy described herein as the preferred embodiment can comprise a plurality of printed circuit dipoles uniformly distributed on a thin flat sheet of a dimensionally stable plastic material, such as Mylar, having a relatively uniform thickness. The sheet can be folded and joined to form a cylindrical surface. The ends can likewise be enclosed with plastic to produce a completely enclosed volume that can be inflated with a suitable gas as a balloon to maintain the cylindrical surface true to its nominal form.

The device can be tethered to provide a self-supporting target at some specified height and location or it can be allowed to drift freely in the atmosphere. The balloon can also be weighted so that it drifts with the axis of the cylinder vertical to thereby provide large echo areas for 360° in azimuth and for about ± 15° from zero elevation angle.

In order to construct such a balloon, a number of flat sheets of plastic film are required, each having printed thereon conducting lines to form dipoles and transmission lines; each sheet can be twisted to simultaneously wind the transmission lines together into a cable and maintain the sheets covered and the dipoles flat. A number of such flat sheets can be joined to form a dipole covered plastic cylinder balloon having the interconnecting cables inside the balloon.

In operation, decoy balloons can be maintained in an inflated manner in a deck house on a ship. If a radar guided missile attack is detected the deck house can be opened to permit the decoy balloon to float away from the ship. At the same time the ship can begin to turn so as to both move away from the deployed decoy balloon and to present an end-on-view (minimum radar echoing area) to the attacker.

In a successful operation, the attacking radar will at first view the ship and the decoy as one single echo; however, as the two move apart the radar will see two echoes separating out from the initial single echo. The radar will follow the largest of these two echoes which can be the echo from the decoy. By the time the missile reaches the position of the decoy the ship should ideally be far enough away to avoid being damaged by the missile.

If so desired, the decoy can be given a preset life. For example, the balloon could be connected to an inflated tube on the skin and as it is released the connection becomes a preset leak of the gas in the balloon. After a selectively predetermined time the balloon will cease to present a large echo and will fall into the sea. The decoy thus ceases to be a target which might confuse friendly radars. Such a balloon can also form a useful radar target for training purposes or for the radar marking of such objects as buoys.

Although the inventive concept has been described with respect to dipoles as radiating elements it should be clearly understood and appreciated that other suitable radiators such as loops or spirals could be used. A cylindrical shape for the balloon is convenient for both manufacturing and inflation purposes but other shapes, such as spheres or cone sections, could of course, be used.

Likewise, although the preferred embodiment has been described with reference to a dipole array that is designed to return energy in the direction of the source, it should be clearly understood that other forms of radiation behavior might be desirable and could be achieved within the present inventive concept. For example, a cylinder could be utilized to return energy at the correct azimuth but at an elevation angle as far below the horizontal as the direction of the source is above the horizontal (mirror reflection in elevation). Such a decoy would return energy to the source via a reflection at the surface of the sea and could be designed to cause attacking missiles to dive into the sea.

Thus it can be seen that a new and novel passive radar decoy having a substantially large echo area similar to large targets has been disclosed. The novel decoy comprises a low-cost, light-weight device that can be easily stored and transported and that can be rapidly deployed.

Obviously many modifications and variations of the present invention are possible in the light of the above teachings. It is therefore to be understood that within the scope of the appended claims the invention may be practiced otherwise than as specifically described.

What is claimed is:

1. A passive, high-cross section radar decoy comprising:

a plastic balloon having a selectively predetermined volume, said balloon having uniformly distributed on the surface thereof a plurality of printed circuit radiators, said radiators being disposed and arranged in a Van Atta array configuration whereby radiant energy from a distant source received by said radiators is reradiated in the direction of the source.

2. The radar decoy of claim 1 wherein said plastic balloon comprises a cylindrical balloon made from a dimensionally stable plastic material.

3. The radar decoy of claim 2 wherein said printed circuit radiators comprise printed circuit dipoles.

4. A passive, low-cost, light-weight radar decoy comprising:

a cylindrical, dimensionally stable, plastic balloon, said balloon having a selectively predetermined volume whereby the echoing area of said decoy substantially simulates a given radar target, a plurality of printed circuit dipoles, said dipoles being uniformly distributed on the surface of said cylindrical balloon, said dispoles being disposed and arranged in a Van Atta array configuration whereby incident radiation from a distant source is reradiated in the direction of the source.

* * * * *